US007523747B2

(12) United States Patent
Gachik et al.

(10) Patent No.: US 7,523,747 B2
(45) Date of Patent: Apr. 28, 2009

(54) METHOD AND SYSTEM FOR LIQUID FUEL CONDITIONING

(75) Inventors: Igor A. Gachik, Boca Raton, FL (US); Lev M. Gurarye, Sunny Isles Beach, FL (US); Victor N. Gurin, Hollywood, FL (US); Yuri S. Levin, Weston, FL (US); Roman J. Press, Pitsford, NY (US); Naum Staroselsky, Sunny Isles Beach, FL (US); Sam Vaynblat, Coral Springs, FL (US)

(73) Assignee: Ultimate Combustion Corporation, Boca Raton, FL (US)

( * ) Notice: Subject to any disclaimer, the term of this patent is extended or adjusted under 35 U.S.C. 154(b) by 0 days.

(21) Appl. No.: 11/859,307

(22) Filed: Sep. 21, 2007

(65) Prior Publication Data

US 2009/0078226 A1 Mar. 26, 2009

(51) Int. Cl.
*F02M 21/02* (2006.01)

(52) U.S. Cl. ..... 123/525; 261/69.1

(58) Field of Classification Search ..... 123/27 GE, 123/536, 525, 514, 533, 511, 515, 518, 1 A, 123/522–524, 527

See application file for complete search history.

(56) References Cited

U.S. PATENT DOCUMENTS 4,068,639 A * 1/1978 Cook ..... 123/525
4,376,423 A * 3/1983 Knapstein ..... 123/1 A
4,596,210 A * 6/1986 Schmidtke ..... 123/1 A
5,833,765 A * 11/1998 Flynn et al. ..... 134/22.12
6,065,455 A * 5/2000 McLean ..... 123/557
6,189,516 B1 * 2/2001 Hei Ma ..... 123/524
6,273,072 B1 * 8/2001 Knapstein et al. ..... 123/527
6,279,541 B1 * 8/2001 Doane et al. ..... 123/497

(Continued)

*Primary Examiner*—Michael Cuff
*Assistant Examiner*—Hung Q Nguyen
(74) *Attorney, Agent, or Firm*—Laurence A. Greenberg; Werner H. Stemer; Ralph E. Locher

(57) ABSTRACT

A fuel is conditioned in a fuel supply system for more efficient combustion in a combustion chamber. The conditioning system includes a fuel vessel for fuel conditioning, at least one fuel dispersing nozzle mounted for discharge into the fuel vessel, at least one gas inlet port and at least one conditioned fuel outlet. A low level sensor registers a lower level of conditioned fuel in the fuel vessel. A high level sensor registers an upper level of conditioned fuel in the fuel vessel. A gas source feeds a gas to the fuel vessel, wherein the gas is dissolved in the liquid fuel for forming a liquid/gas fuel solution. A low-pressure fuel pump and a liquid fuel supply line supply liquid fuel from a fuel reservoir to the at least one dispersing nozzle of the fuel vessel at a pressure $P_1$ higher than the gas pressure $P_2$. A needle valve positioned downstream the fuel chamber, lowers the pressure, created in the fuel chamber by gas pressure $P_2$, to lower level $P_3$ downstream the needle valve. A resulting over-saturation causes gas to escape from solution. A high-pressure fuel pump feeds the homogeneous liquid into a combustion chamber at a pressure $P_4$ that is higher than a pressure $P_5$ in the combustion chamber at a moment of combustion. Finally, there is provided an electronic control system connected to receive a signal from the low level sensor and from the high level sensor for controlling the fuel level in the fuel chamber.

6 Claims, 3 Drawing Sheets

U.S. PATENT DOCUMENTS 6,311,649 B1 * 11/2001 Ma ..... 123/3
6,694,744 B1 * 2/2004 Smith ..... 60/775
6,695,895 B2 * 2/2004 Hyodo et al. ..... 96/111
6,711,893 B2 * 3/2004 Ueda et al. ..... 60/285
6,742,479 B2 * 6/2004 Yanagisawa ..... 123/1 A
7,011,048 B2 * 3/2006 Gurin et al. ..... 123/1 A
7,281,500 B1 * 10/2007 Firey et al. ..... 123/23
7,305,975 B2 * 12/2007 Reddy ..... 123/520
7,316,228 B2 * 1/2008 Maegawa et al. ..... 123/698
7,343,905 B2 * 3/2008 Willi et al. ..... 123/527
7,373,932 B2 * 5/2008 Hayashi et al. ..... 123/549
7,406,955 B1 * 8/2008 Gachik et al. ..... 123/522
7,418,927 B2 * 9/2008 Firey ..... 123/23
2002/0134323 A1 * 9/2002 Yanagisawa ..... 123/1 A
2002/0134346 A1 * 9/2002 Yamauchi et al. ..... 123/295
2003/0116142 A1 * 6/2003 Miller et al. ..... 123/516
2005/0240336 A1 * 10/2005 Reddy ..... 701/103
2006/0054145 A1 * 3/2006 Hayashi et al. ..... 123/527
2007/0199548 A1 * 8/2007 Maegawa et al. ..... 123/520
2008/0098987 A1 * 5/2008 Firey ..... 123/456

* cited by examiner

METHOD AND SYSTEM FOR LIQUID FUEL CONDITIONING

BACKGROUND OF THE INVENTION

Field of the Invention

The present invention relates to liquid fuel conditioning and, more particularly, to the dissolution of gasses under pressure in the liquid fuel and then injecting the solution into a combustion chamber. The purpose is to achieve a high degree of dispersion of the fuel in the combustion chamber of the reciprocating or gas turbine engine, or any other device having a combustion chamber.

It is common knowledge that the dispersion of a liquid fuel results in a highly developed active surface of this liquid fuel which allows to burn fuel more efficiently. The small size of the combustion chamber in a reciprocating engine, for example, results in the partial deposition of the injected fuel on the piston and combustion chamber walls creating a liquid film on them. This part of fuel can not be burnt completely and is getting lost with exhaust. Uneven distribution of the uneven liquid fuel particles over the volume of the combustion chamber causes a delay in the flame propagation, lowering the efficiency of the combustion process—delivering less power. High dispersion of the fuel would allow avoiding these problems. Completely burned fuel delivers more power, the temperature of the combustion drops and the amount of environmentally polluting exhaust gases (e.g., $NO_x$ and $CO_2$) also diminishes with the decrease in the exhaust temperature.

There are different ways to provide dispersion of the liquid fuel, for instance with the help of fuel injectors or carburetors. Latest efforts in the area of fuel injection by the most prominent automotive engine builders have resulted in the development of very high pressure injection systems—up to 2400 bar. On the one hand, this level of pressure is providing for very fine dispersion of fuel—thus ensuring a significantly improved efficiency of the internal combustion engine—but on the other hand, the level of pressure requires more reliable and more expensive technology.

There are known attempts to disperse fuel by dissolving some gas, for instance air or $CO_2$ in the liquid fuel and subsequently injecting the solution into the combustion chamber. When injected into the combustion chamber where pressure is lower than in the solution, dissolved gas is violently released from the solution, providing for very fine and uniform dispersion of the liquid fuel.

Reference is had, in this context, to prior art patents, such as, for instance U.S. Pat. Nos. 4,596,210; 6,273,072; and U.S. Pat. No. 7,011,048 B2. Those patents describe devices and methods that provide for the implementation of the described effect.

Commonly assigned patent U.S. Pat. No. 7,011,048 B2 describes fuel modification system which particularly comprises device for facilitating gas dissolution in the liquid fuel with help of highly developed absorbing surfaces created by corrugated inserts placed in specially design for this purpose vessel. Since the prepared in that vessel solution turned out saturated, after that it is subjected to compression with the help of high-pressure pump for preventing a development of gas bubbles in the solution, when it is further on its way to the combustion chamber. For the same purpose this fuel conditioning system is equipped with cooling device—according to Henry's Law, saturation point (maximum concentration of gas in a gas/liquid solution) is raised when the pressure increases and when the temperature decreases.

As mentioned above, the described embodiment requires a specially designed device which is supposed to work within a certain range of parameters (laminar flow rate of fuel and certain pressure of gas and fuel) to provide for proper dissolution of gas in liquid fuel, and, at the same time, the gas and liquid fuel is supposed to have certain parameters for proper work of the combustion chamber feeding system. It is difficult to satisfy both of these requirements simultaneously.

BRIEF SUMMARY OF THE INVENTION

It is accordingly an objective of this invention to provide a method and apparatus which overcomes the above-mentioned disadvantages and which provides for further improvement in the fuel/gas solution injection into a combustion chamber.

With the above and other objects in view there is provided, in accordance with the invention, a fuel conditioning and combustion chamber feeding system, comprising:

a vessel for fuel conditioning, at least one fuel dispersing nozzle mounted for discharging fuel into said vessel, and at least one gas inlet port for feeding gas into said vessel;

a gas source fluidly connected with a gas pressure regulator for maintaining a gas pressure $P_2$;

said gas pressure regulator being fluidically connected with said gas inlet port for feeding a gas into said vessel, whereby the gas is dissolved in the liquid fuel for forming a liquid/gas fuel solution;

a low-pressure fuel pump and a liquid fuel supply line for supplying liquid fuel from a fuel reservoir to said at least one dispersing nozzle of said vessel at a pressure $P_1$ higher than said gas pressure $P_2$;

means for creating over-saturating conditions in a flow of the liquid fuel and a liquid fuel supply line for supplying liquid fuel from the vessel to the means;

a high-pressure fuel pump for feeding conditioned fuel to a combustion chamber at a high pressure $P_4$ higher than a pressure $P_5$ in the combustion chamber at a moment of combustion and a liquid fuel/gas bubbles mixture supply line for supplying a liquid fuel/gas bubbles mixture from the over-saturation means to the high-pressure fuel pump; and a liquid fuel/gas bubbles mixture return line for feeding excess liquid fuel/gas bubbles mixture back to said high-pressure fuel pump.

The means for creating over-saturating conditions may take any of a plurality of implementations. For instance, we may provide a needle valve configured to cause a pressure of the liquid fuel to drop to a pressure $P_3$ lower than the gas pressure $P_2$. In the alternative, the over-saturating conditions may be achieved by subjecting the fuel to ultra-sound exposure. In addition, or in the alternative, it may also be possible to subject the fuel to local heating.

In accordance with an added feature of the invention, the system includes a high level sensor for registering a high level of conditioned fuel in said vessel, low level sensor for registering a low level of conditioned fuel in said vessel, and an electronic control system connected to receive a signal from said fuel low level sensor and from said fuel high level sensor, respectively, to maintain a supply of conditioned fuel in said vessel.

In accordance with an additional feature of the invention, the fuel pressure $P_1$ is set higher than the gas pressure $P_2$ by a sufficient amount to ensure a fuel pressure drop sufficient for satisfactory dispersion by said nozzle.

In accordance with an another feature of the invention, the fuel pressure $P_3$ is set lower than the gas pressure $P_2$ by a sufficient amount to ensure a liquid fuel pressure drop sufficient for creating over-saturating conditions in the fuel (e.g., downstream of the needle valve, or following ultrasound irradiation).

With the above and other objects in view, there is also provided, in accordance with the invention, a method of conditioning fuel and supplying conditioned fuel to a combustion process, the method which comprises:

providing a vessel for fuel conditioning, the vessel having a housing, at least one fuel dispersing nozzle, a gas inlet port, a fuel outlet port, at least one level sensor for registering an upper level of conditioned fuel in the vessel and at least one level sensor for registering a lower level of conditioned fuel in the vessel;

feeding liquid fuel into the vessel at a relatively high pressure $P_1$ higher than a given gas pressure $P_2$ and thereby setting a pressure drop at the nozzle sufficient to satisfactorily disperse the fuel, and setting a volume of fuel flow through the nozzle sufficient for filling up the vessel at the rate not lower than a rate of the fuel consumption by a combustion chamber;

feeding at least one gas into the vessel through the gas inlet at the gas pressure $P_2$ during the processes of fuel conditioning in the vessel and of feeding conditioned fuel into a high-pressure fuel pump and further into the combustion chamber;

creating over-saturating conditions (e.g., setting a pressure drop at a needle valve from the gas pressure $P_2$ to a pressure $P_3$ or subjecting to ultra-sound or the like) and providing for a sufficient amount of gas escaping from the solution for the further dissolution of the gas in the high-pressure fuel pump; and conditioning more fuel and filling the vessel with conditioned fuel upon receiving a signal from the sensor for registering low level of conditioned fuel in the vessel, and automatically switching the conditioning and feeding off upon receiving a signal from the sensor for registering a high level of conditioned fuel in the vessel.

With the above and other objects in view, there is also provided, in accordance with the invention, a fuel conditioning system for an internal combustion engine fuel delivery system, including a fuel injection system for injecting into a combustion chamber of the internal combustion engine. The fuel conditioning system comprises the following:

a vessel for fuel conditioning, said vessel having a housing and at least one fuel dispersing nozzle mounted therein and gas inlet port;

a fuel outlet port and sensors for a conditioned fuel upper level control and conditioned fuel lower level control in said vessel;

a low-pressure pump for providing liquid fuel flow at a low pressure to at least one dispersing nozzle mounted in said fuel conditioning vessel, the pressure being set to a level higher than a level of the gas pressure in said vessel to provide for a fuel pressure drop sufficient for satisfactory dispersion of fuel by said nozzle;

means (such as a needle valve, for example, for causing a pressure drop from the level provided by low-pressure pump to the level sufficient) for creating over-saturating conditions in the flow (e.g., downstream of the needle valve); and a high-pressure pump for feeding a fuel/gas mixture into a combustion chamber at a pressure higher than a pressure level in said combustion chamber at the moment of combustion; and a piping circuit fluidically interconnecting various components of the system.

An internal combustion engine with a fuel supply system having a fuel supply tank, a low-pressure fuel pump, a fuel conditioning vessel and a high-pressure fuel pump, is provided together with compressor (for air) or gas supply tank (for air or $CO_2$) and piping system, fluidly connecting all of the above. The fuel conditioning vessel is equipped with at least one nozzle, dispersing pressurized fuel delivered from the fuel tank by low pressure fuel pump to the fuel conditioning vessels and is equipped with upper level and lower level registering sensors for level control of the conditioned fuel. The fuel conditioning vessel is also equipped with a gas inlet and with a conditioned fuel outlet located at the bottom of the fuel conditioning vessels for feeding conditioned fuel to the means for creating over-saturating conditions (e.g., needle valve, ultrasound head, etc.) and further to the high-pressure fuel pump. The gas supply source—a gas tank (for air or $CO_2$) or a compressor (for air) is equipped with a pressure regulator for ability to control a pressure of gas supplied to the fuel conditioning vessel. A recirculation line is provided for returning a conditioned fuel excess, pumped by the high-pressure fuel pump, back to the fuel inlet of the high-pressure fuel pump and a check valve is installed in line between the over-saturation means and the high-pressure fuel pump.

In another embodiment a recirculation line is provided for returning a conditioned fuel excess, pumped by the high-pressure fuel pump, back to the fuel conditioning vessel.

Yet in another embodiment a recirculation line is provided for returning a conditioned fuel excess, pumped by the high-pressure fuel pump, back to the fuel supply tank.

In the last two embodiments there is no need for the check valve installation between the fuel conditioning vessel and the high-pressure fuel pump.

Other features which are considered as characteristic for the invention are set forth in the appended claims.

Although the invention is illustrated and described herein as embodied in method and system for liquid fuel conditioning, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
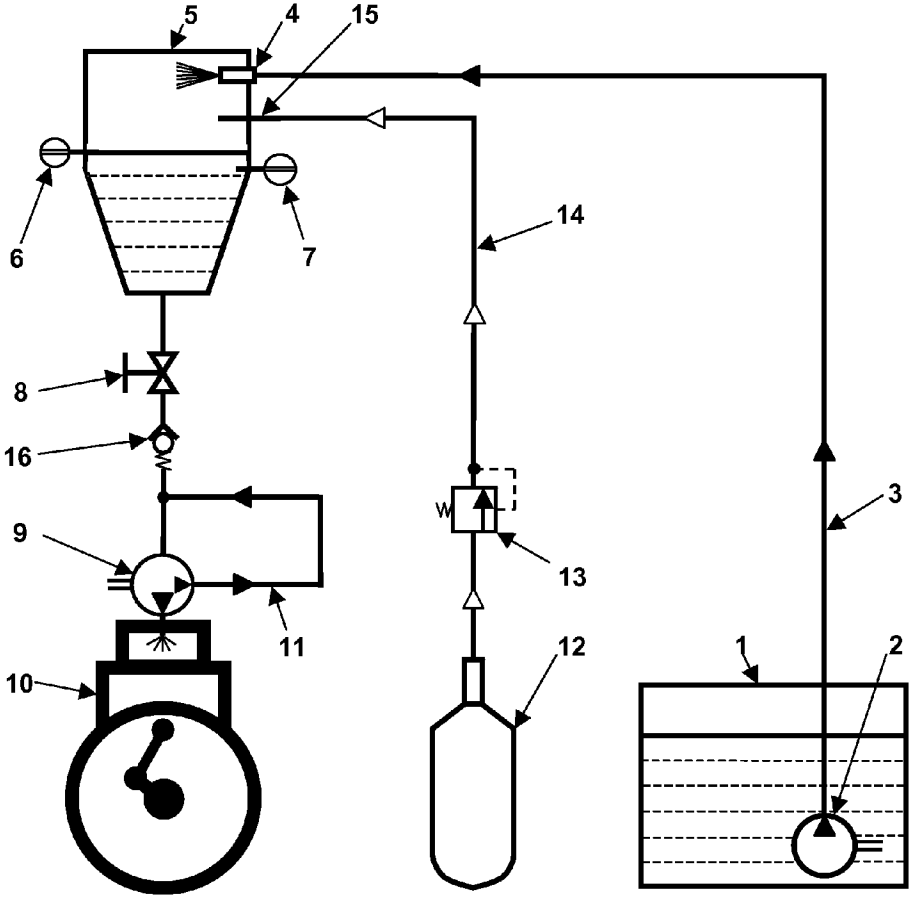
FIG. 1 is a diagrammatic view of the fuel system with recirculation line feeding excess of the conditioned fuel back to the intake of the high pressure fuel pump.
Figure 2:
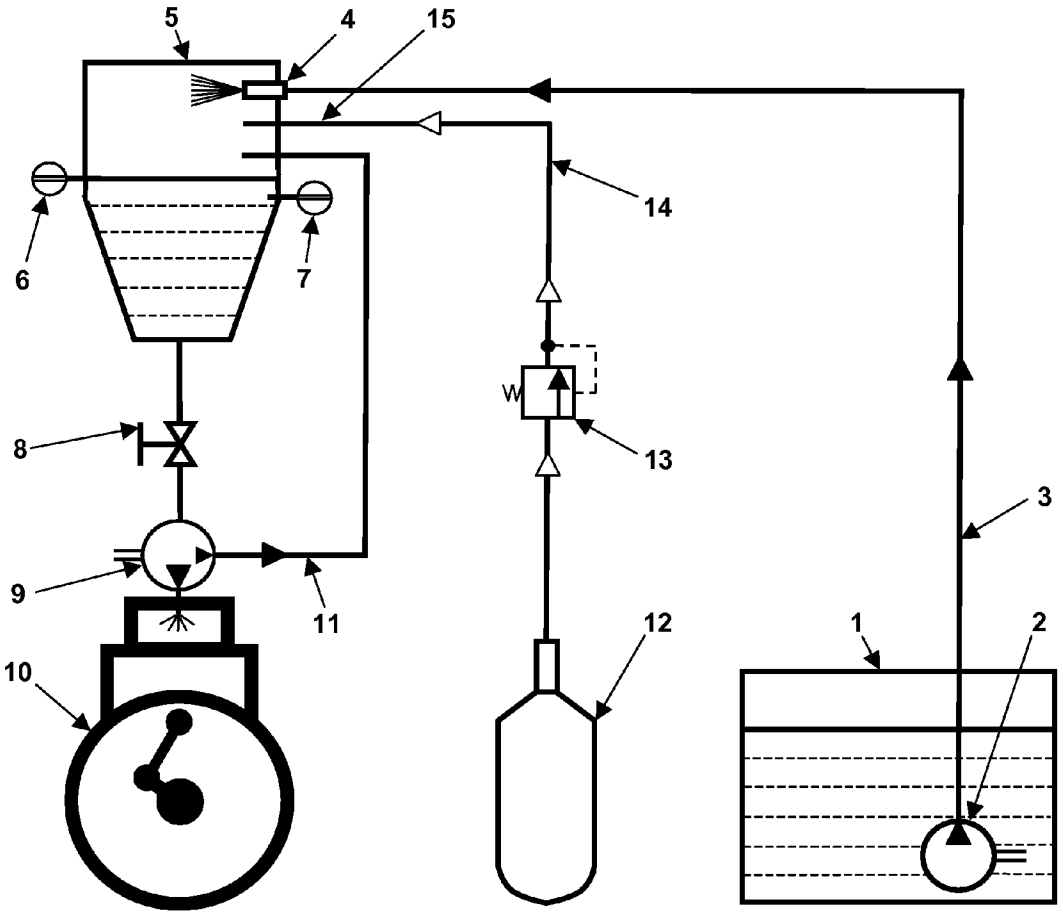
FIG. 2 is a diagrammatic view of the fuel system with recirculation line feeding excess of the conditioned fuel back to the conditioning vessel.
Figure 3:
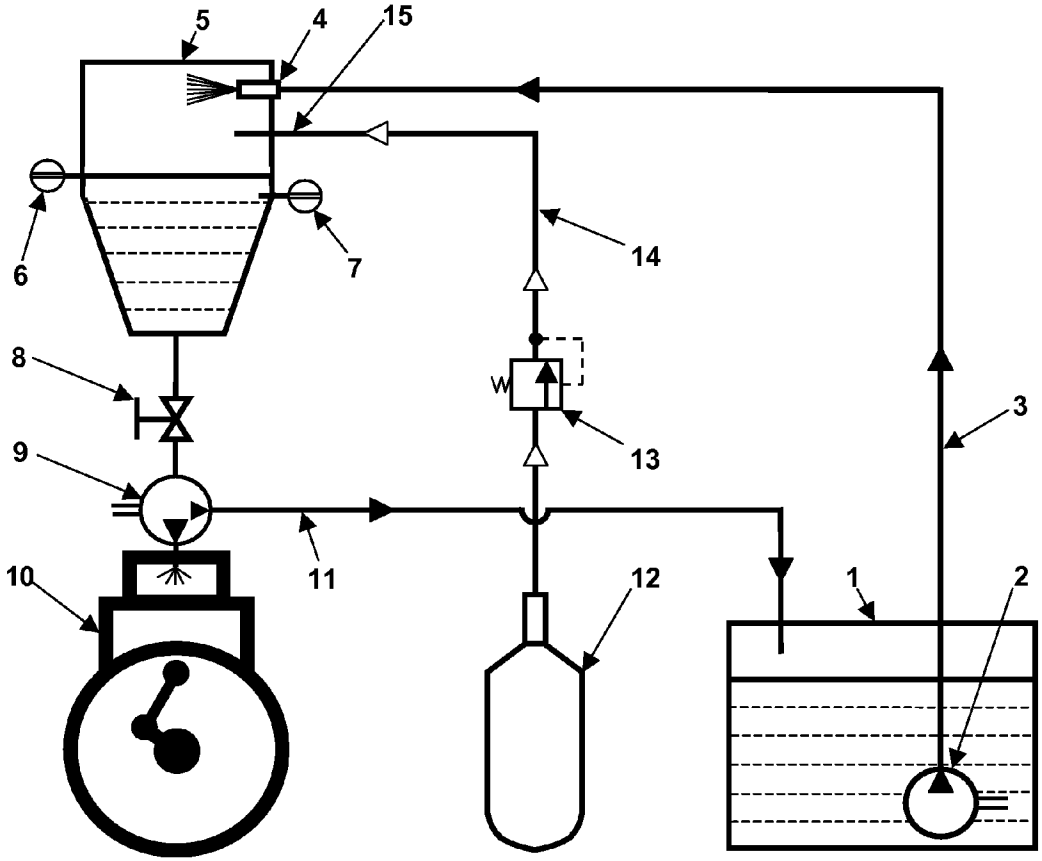
FIG. 3 is a diagrammatic view of the fuel system with recirculation line feeding excess of the conditioned fuel back to the fuel tank.

Referring now to the figured of the drawing in detail, the system consists of the fuel tank 1, the low-pressure fuel pump 2 for delivering liquid fuel from the fuel tank 1 by the fuel line 3 to at least one nozzles 4 mounted in the fuel conditioning vessel 5. The low-pressure fuel pump provides fuel pressure $P_1$. The upper level of fuel in the fuel conditioning vessel 5 is registered by the sensor 6 and lower level of the conditioned fuel in the fuel conditioning vessel 5 is registered by the sensor 7. The source of the compressed gas 12 (for instance air or $CO_2$) is fluidically connected by the line 14 to the inlet of the pressure reducer 13 which is controlling pressure of gas at the level $P_2$ downstream in the line 15.

Gas pressure $P_2$ is set up lower than the fuel pressure $P_1$ created by low-pressure fuel pump 2 at the level providing satisfactory working condition for the nozzle 4. The dispersion of fuel in gas results in significant amount of gas getting dissolved in fuel.

The line 14 is further fluidly connecting pressure reducer 13 with the gas inlet 15 of the fuel conditioning vessel 5. The outlet of the fuel conditioning vessel 5 is fluidly connected to the needle valve 8 provided for lowering the downstream pressure to the level $P_3$. A fuel is delivered downstream needle valve 8 to the high-pressure fuel pump 9 which is fluidly connected to the fuel injectors (not shown) of the internal combustion engine 10. Since high-pressure fuel pump 9 is capable of delivering much bigger volume of the fuel than can be consumed by the internal combustion engine 10 in the same period of time, a recirculation line 11 is provided for return of the fuel excess back to the inlet of the high-pressure fuel pump 10. There is a fuel level control system comprise low level control switch 7 and high level control switch 6 both mounted in the conditioning vessel 5 to provide for near permanent conditions of solution preparation.

The liquid fuel is pumped by the low-pressure fuel pump 2 into the conditioning vessel 5. The fuel is getting dispersed in the upper zone of the conditioning vessel 5 where compressed gas (for instance air or $CO_2$) is delivered from the compressed gas tank 12 (in case of using $CO_2$) or air compressor (not shown) by means of the gas inlet 15. The pressure of gas $P_2$ is set up lower than the pressure $P_1$ provided by the low-pressure fuel pump 2 to guaranty satisfactory working conditions for the nozzle 4. Dispersing of the liquid fuel into the gas occupied upper zone of the conditioning vessel 5 results in dissolving certain amount of gas in the liquid fuel. The amount of gas dissolved in the liquid fuel depends on the temperature of the liquid and pressure $P_2$ in the conditioning vessel 5. High level control switch 7 and low level control switch 6 are positioned in the conditioning vessel 5 at small vertical distance from each other to ensure insignificant volume variations of the liquid and gas filled spaces of the conditioning vessel 5 to provide for near permanent conditions of the liquid solution preparation. The liquid solution, prepared in the conditioning vessel 5 and pressurized by gas to the pressure $P_2$ is further delivered to the needle valve 8 which is set up to reduce pressure after it in the liquid solution to the level $P_3$.

As a result significant amount of gas dissolved in the liquid fuel escapes from it in form of bubbles. The mixture of liquid solution and bubbles created down stream needle valve 8 is delivered to the high-pressure fuel pump, where it is getting compressed to the state of homogeneous liquid solution, and is further injected in the combustion chamber of the internal combustion engine 10.

Since the pressure in the injected liquid solution is higher than the pressure in the combustion chamber of the internal combustion engine 10, dissolved in the liquid solution gas violently escapes from the liquid, breaking it in the very small liquid fuel particles, providing for particles even distribution over the volume of the combustion chamber and for the speedy propagation of the burning front. This way fuel is having burnt before it could reach walls of the combustion chamber and bottom of the piston of the internal combustion engine creating cold film on its surfaces. Faster and more efficiently burnt fuel delivers more energy, so it takes less fuel to produce the same amount of power.

Since fuel feeding system delivers more fuel than internal combustion engine can consume in the same period of time, recirculation loop 11 is provided for returning excess fuel back into the flow. In case of returning this excess fuel to the inlet of high-pressure fuel pump 9, the check valve 16 is installed upstream of the connection of the return line with the inlet of the high-pressure fuel pump 9.

The invention claimed is:

1. A fuel conditioning and combustion chamber feeding system, comprising:

a vessel for fuel conditioning, at least one fuel dispersing nozzle mounted for discharging fuel into said vessel, and at least one gas inlet port for feeding gas into said vessel;

a gas source fluidically connected with a gas pressure regulator for maintaining a gas pressure $P_2$;

said gas pressure regulator being fluidically connected with said gas inlet port for feeding a gas into said vessel, whereby the gas is dissolved in the liquid fuel for forming a liquid/gas fuel solution;

a low-pressure fuel pump and a liquid fuel supply line for supplying liquid fuel from a fuel reservoir to said at least one dispersing nozzle of said vessel at a pressure $P_1$ higher than said gas pressure $P_2$;

means for creating over-saturating conditions in a flow of the liquid fuel and a liquid fuel supply line for supplying liquid fuel from said vessel at a fuel pressure $P_3$ set lower than the gas pressure $P_2$ by a sufficient amount to ensure a liquid fuel pressure drop sufficient for creating the over-saturating conditions in the flow downstream of said vessel;

a high-pressure fuel pump for feeding conditioned fuel to a combustion chamber at a high pressure $P_4$ higher than a pressure $P_5$ in the combustion chamber at a moment of combustion and a liquid fuel/gas bubbles mixture supply line for supplying a liquid fuel/gas bubbles mixture to said high-pressure fuel pump; and a liquid fuel/gas bubbles mixture return line for feeding excess liquid fuel/gas bubbles mixture back to said high-pressure fuel pump.

2. The system according to claim 1, which further comprises a high level sensor for registering a high level of conditioned fuel in said vessel, low level sensor for registering a low level of conditioned fuel in said vessel, and an electronic control system connected to receive a signal from said fuel low level sensor and from said fuel high level sensor, respectively, to maintain a supply of conditioned fuel in said vessel.

3. The system according to claim 1, wherein the fuel pressure $P_1$ is set higher than the gas pressure $P_2$ by a sufficient amount to ensure a fuel pressure drop sufficient for satisfactory dispersion by said nozzle.

4. A method of conditioning fuel and supplying conditioned fuel to a combustion process, the method which comprises:

(a) providing a vessel for fuel conditioning, the vessel having a housing, at least one fuel dispersing nozzle, a gas inlet port, a fuel outlet port, at least one level sensor for registering an upper level of conditioned fuel in the vessel and at least one level sensor for registering a lower level of conditioned fuel in the vessel;

(b) feeding liquid fuel into the vessel at a relatively high pressure $P_1$ higher than a given gas pressure $P_2$ and thereby setting a pressure drop at the nozzle sufficient to satisfactorily disperse the fuel, and setting a volume of fuel flow through the nozzle sufficient for filling up the vessel at the rate not lower than a rate of the fuel consumption by a combustion chamber;

(c) feeding at least one gas into the vessel through the gas inlet at the gas pressure $P_2$ during the processes of fuel conditioning in the vessel and of feeding conditioned fuel into a high-pressure fuel pump and further into the combustion chamber;

(d) creating over-saturating conditions and providing for a sufficient amount of gas escaping from the solution for the further dissolution of the gas in the high-pressure fuel pump by feeding the conditioned fuel through a needle valve, and setting a fuel pressure $P_3$ downstream of the needle valve lower than the gas pressure $P_2$ upstream of the needle valve; and (e) conditioning more fuel and filling the vessel with conditioned fuel upon receiving a signal from the sensor for registering low level of conditioned fuel in the vessel, and automatically switching the conditioning and feeding off upon receiving a signal from the sensor for registering high level of conditioned fuel in the vessel.

5. The method according to claim 4, wherein the fuel pressure $P_1$ is set higher than the gas pressure $P_2$ by an amount sufficient to provide for a fuel pressure drop sufficient for satisfactory dispersion of the liquid fuel by the nozzle.

6. The method according to claim 4, wherein a level of the gas concentration in the solution exceeds the solution saturation level for conditions present in the combustion chamber at a moment of injection.

* * * * *